US008174207B2

(12) United States Patent
Ahn et al.

(10) Patent No.: US 8,174,207 B2
(45) Date of Patent: May 8, 2012

(54) LAMP AND DRIVING DEVICE FOR BACKLIGHT ASSEMBLY HAVING THE SAME

(75) Inventors: Jong Ki Ahn, Daegu-si (KR); Sung Yong Park, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 116 days.

(21) Appl. No.: 12/379,057

(22) Filed: Feb. 11, 2009

(65) Prior Publication Data

US 2009/0153074 A1 Jun. 18, 2009

Related U.S. Application Data

(62) Division of application No. 11/159,234, filed on Jun. 23, 2005, now abandoned.

(30) Foreign Application Priority Data

Aug. 31, 2004 (KR) ..... 10-2004-0069139

(51) Int. Cl.
*H05B 37/02* (2006.01)

(52) U.S. Cl. ..... 315/291; 345/102; 315/209 R; 315/224; 315/225; 315/226

(58) Field of Classification Search ..... 315/209 R, 315/210, 224–226, 246, 250, 291, 312, 324, 315/362, DIG. 1; 345/102
See application file for complete search history.

(56) References Cited

U.S. PATENT DOCUMENTS

| | | | | |
|---|---|---|---|---|
| 4,074,172 | A | 2/1978 | Wesselink et al. | |
| 6,094,015 | A * | 7/2000 | Wessels et al. | 315/291 |
| 6,605,905 | B2 | 8/2003 | Kosa et al. | |
| 6,956,556 | B2 * | 10/2005 | Yajima et al. | 345/102 |
| 7,077,543 | B2 * | 7/2006 | Nishiyama et al. | 362/225 |
| 2003/0214478 | A1 * | 11/2003 | Yoo et al. | 345/102 |

FOREIGN PATENT DOCUMENTS

| | | |
|---|---|---|
| CN | 1121707 | 5/1996 |
| WO | WO 03/001550 | 1/2003 |

* cited by examiner

*Primary Examiner* — Thuy Vinh Tran
(74) *Attorney, Agent, or Firm* — McKenna Long & Aldridge LLP

(57) ABSTRACT

A device for driving a backlight assembly includes a controller for outputting a control signal, a switching unit for outputting a DC square wave voltage in response to the control signal, an inverter for converting the DC square wave voltage into an AC voltage and a lamp for emitting light in response to the AC voltage, the lamp includes first and second glass tube portions having respective one ends bent and connected integrally to each other, first and second electrodes respectively formed at respective other ends of the first and second glass tube portions and a third electrode formed at the bent portion of the first and second glass tube portions, wherein electrical characteristics of the lamp are detected through the third electrode, wherein the electrical characteristics include voltage, current and impedance of the lamp.

5 Claims, 7 Drawing Sheets

LAMP AND DRIVING DEVICE FOR BACKLIGHT ASSEMBLY HAVING THE SAME

This application is a Divisional of application Ser. No. 11/159,234 filed Jun. 23, 2005, now abandoned; which claims priority to Korean Patent Application No. 10-2004-0069139, filed Aug. 31, 2004, all of which are hereby incorporated by reference for all purposes as if fully set forth herein.

BACKGROUND OF THE INVENTION

1. Field of the Invention

The present invention relates to a liquid crystal display device, and more particularly, to a lamp and a driving device for a backlight assembly having the same.

2. Description of the Related Art

Examples of flat panel displays include plasma display panels (PDPs), field emission displays (FEDs), and liquid crystal displays (LCDs). The flat panel displays are broadly classified into light-emitting type displays and light-receiving type displays. PDPs and FEDs are light-emitting type displays, and LCDs are light-receiving type displays. The LCD cannot display an image without an external light source because it is not self-luminous. Therefore, the LCD requires a backlight assembly for emitting light.

General requirements of the backlight assembly include high brightness, high efficiency, uniform brightness, long lifetime, thin profile, light weight and low cost. Generally, a notebook computer is equipped with a high-efficiency and long-lifetime backlight assembly so as to reduce its power consumption, and a PC monitor or a TV can also be equipped with a high-brightness backlight assembly.

A backlight assembly is equipped with a lamp or a plurality of lamps as a light source. Backlight assemblies are classified into either an edge type or a direct type. In the edge type backlight assembly, a lamp is disposed at an edge of a liquid crystal panel and a light guide plate guides light emitted from the lamp toward the liquid crystal panel. The lamp can be disposed at one edge or a plurality of lamps can be disposed at different edges of the liquid crystal panel, for example, both left and right edges. Also, the plurality of lamps can be disposed at all edges of the liquid crystal panel. Meanwhile, in the direct type backlight assembly, a plurality of lamps are disposed at the rear of a liquid crystal panel and spaced apart from one another by a predetermined distance, such that they directly illuminate the liquid crystal panel. In both types of backlight assemblies, a cold cathode fluorescent lamp (CCFL) is widely used because of its high brightness.

FIG. 1A is a view of a straight-shaped CCFL in the related art backlight assembly, and FIG. 1B is a view of a U-shaped CCFL in the related art backlight assembly.

Referring to FIG. 1A, the straight-shaped CCFL includes a cylindrical glass tube 1 and electrodes 2 and 3 at both ends thereof. The glass tube 1 is elongated along a straight line, and the electrodes 2 and 3 are disposed at both ends of the glass tube 1. A predetermined voltage is supplied across the electrodes 2 and 3 of the glass tube 1. One end of each of the electrodes 2 and 3 is inside the glass tube 1. Therefore, the predetermined voltage is directly supplied to the inner space of the glass tube 1, causing a discharge therein. This straight-shaped CCFL is widely used in the backlight assembly because it has a high brightness of several ten thousands cd/m$^2$.

To meet the lighting requirements of large-sized liquid crystal panels, the direct type backlight assembly is widely used. However, the direct type backlight assembly requires many lamps for directly illuminating the large-sized liquid crystal panel. Since the lamps are separately driven, a lamp drive circuit of the direct type backlight assembly is complex and bulky. To solve these problems, various attempts have been made to alter the structure of the lamp. For example, a U-shaped CCFL and a zigzag CCFL have been proposed.

Referring to FIG. 1B, the U-shaped CCFL includes cylindrical glass tube portions 5 and 6 and electrodes 8 and 9. The glass tube portions 5 and 6 are paired in one body. One end of each of the glass tube portions 5 and 6 is bent and connected at a bent portion 7. The electrodes 8 and 9 are exposed inside the other end of each of the glass tube portions 5 and 6. Consequently, the glass tube portions 5 and 6, and the bent portion 7 are formed in a U-shape.

Accordingly, one U-shaped CCFL corresponds to two straight CCFLs. Therefore, the required number of the U-shaped CCLFs is ½ of that of the straight CCFLs. Since only one driving voltage is required for one U-shaped CCFL corresponding to two straight CCFLs requiring two driving voltages, a lamp driving circuit can be simplified. Consequently, a required cost can be reduced. Typically, the U-shaped CCFLs is driven in a floating type manner.

FIG. 2 is a schematic diagram illustrating a driving device for a backlight assembly having the U-shaped lamp shown in FIG. 1B. Referring to FIG. 2, the backlight assembly driving device includes a controller 11 for outputting a PWM (pulse width modulation) control signal, a power transistor 13 for converting an external DC voltage into a DC square wave voltage in response to the control signal, a resonant inverter 15 for converting the DC square wave voltage into an AC sine wave voltage, and a U-shaped lamp 17 for emitting light by the AC sine wave voltage.

Although only one resonant inverter is illustrated in FIG. 2, two resonant inverters are required for providing an AC voltage to each of electrodes 8 and 9 in the U-shaped lamp 17.

A first Ac voltage and a second AC voltage are applied respectively to the electrodes 8 and 9. Here, a phase of the first AC voltage is opposite to that of the second AC voltage. Therefore, an attenuated voltage (ideally, OV) exists at the bent portion 7 of the lamp 17.

Glass tube portions 5 and 6 have the same length and a phase of the first AC voltage is always opposite to that of the second AC voltage between the electrode and at the bent portion 7. Therefore, the first AC voltage is cancelled out by the second AC voltage at the bent portion 7. This is called a floating type driving. Accordingly, when the first and second AC voltages having opposite phases are supplied respectively to the electrodes 8 and 9, the glass tube portions 5 and 6 can emit light of the same brightness.

The resonant inverter 15 has an impedance due to an inductor and a capacitor. Also, the U-shaped lamp 17 has an inherent impedance. Each impedance of the resonant inverter 15 and the U-shaped lamp 17 is varied by external factors (such as noise). Accordingly, the glass tube portions 5 and 6 have different impedance values. This impedance difference causes a canceling out of the first and second AC voltages at a portion of the glass tube 5 or 6 other than at the bent portion 7. Light is not generated at the portion where the first and second Ac voltages are cancel each other out. Also, a tube current flows through the glass tube portions 5 and 6 when a discharge is generated in the glass tube portions 5 and 6 by the first and second AC voltages. This tube current varies according to an impedance. Therefore, due to the impedance difference, respective tube currents flowing through the glass tube portions 5 and 6 become different to each other. The glass tube portion with a larger tube current has high brightness and the glass tube portion with a smaller tube current has low brightness. This causes a non-uniformity in brightness.

A unit (not shown) for detecting electrical characteristics (e.g. voltage, current, and impedance) of the U-shaped lamp 17 is connected between the resonant inverter 15 and the U-shaped lamp 17. Electrical characteristics detected by the unit are supplied to the controller 11 and a corresponding control operation is accordingly performed. Since the unit is connected between the resonant inverter 15 and the U-shaped lamp 17, the accurate impedance of the U-shaped lamp 17 cannot be detected. The first and second AC voltages can only be controlled when the impedance difference between the glass tube portions 5 and 6 is accurately detected. However, since the unit is provided in front of the U-shaped lamp 17, an impedance difference between the glass tube portions 5 and 6 cannot be accurately detected.

A long U-shaped lamp 17 is required for a large-sized liquid crystal panel. When the U-shaped lamp 17 is long, the first and second AC voltages drop due to the internal impedance of the glass tube portions 5 and 6. A large voltage drop occurs at the bent portion 7. While the end portions of the glass tube portions have high brightness, the bent portion 7 has low brightness. This causes a non-uniform brightness.

SUMMARY OF THE INVENTION

Accordingly, the present invention is directed to a lamp and a driving device for a backlight assembly having the same that substantially obviate one or more problems due to limitations and disadvantages of the related art.

An object of the present invention is to provide a lamp and a driving device for a backlight assembly having the same, which can provide stable electrical characteristics.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a lamp including first and second glass tube portions for emitting light, respective one ends of the first and second glass tube portions being bent and connected integrally to each other, first and second electrodes respectively formed at respective other ends of the first and second glass tube portions, and a third electrode formed at the bent portion of the first and second glass tube portions.

In another aspect of the present invention, there is provided a device for driving a backlight assembly, the device has a controller for outputting a control signal, a switching unit for outputting a DC square wave voltage in response to the control signal, an inverter for converting the DC square wave voltage into an AC voltage, and a lamp for emitting light in response to the AC voltage, the lamp including: first and second glass tube portions having respective one ends bent and connected integrally to each other; first and second electrodes respectively formed at respective other ends of the first and second glass tube portions; and a third electrode formed at the bent portion of the first and second glass tube portions, wherein the third electrode is grounded.

In a further another aspect of the present invention, there is provided a device for driving a backlight assembly, the device has a controller for outputting a control signal, a switching unit for outputting a DC square wave voltage in response to the control signal, an inverter for converting the DC square wave voltage into an AC voltage, and a lamp for emitting light in response to the AC voltage, the lamp including: first and second glass tube portions having respective one ends bent and connected integrally to each other; first and second electrodes respectively formed at respective other ends of the first and second glass tube portions; and a third electrode formed at the bent portion of the first and second glass tube portions, wherein electrical characteristics of the lamp are detected through the third electrode.

In yet another aspect of the present invention, there is provided a device for driving a backlight assembly, the device has a controller for outputting a control signal, a switching unit for outputting a DC square wave voltage in response to the control signal, an inverter for converting the DC square wave voltage into an AC voltage, and a lamp for emitting light in response to the AC voltage, the lamp including: first and second glass tube portions having respective one ends bent and connected integrally to each other; first and second electrodes respectively formed at respective other ends of the first and second glass tube portions; and a third electrode formed at the bent portion of the first and second glass tube portions, wherein an AC voltage having a phase opposite to a phase of an AC voltage supplied to the first and second electrodes is supplied to the third electrode.

In an yet another aspect of the present invention, there is provided a liquid crystal display device having a liquid crystal panel for displaying an image, and a unit for driving a backlight assembly to supply light to the liquid crystal panel, the unit including: a controller for outputting a control signal; a switching unit for outputting a DC square wave voltage in response to the control signal; an inverter for converting the DC square wave voltage into an AC voltage; and a lamp emit light in response to the AC voltage, the lamp includes first and second glass tube portions having respective one ends bent and connected integrally to each other, first and second electrodes respectively formed at respective other ends of the first and second glass tube portions, and a third electrode formed at the bent portion of the first and second glass tube portions, wherein the third electrode is grounded.

In a yet another aspect of the present invention, there is provided a liquid crystal display device having a liquid crystal panel for displaying an image, and a unit for driving a backlight assembly to supply light to the liquid crystal panel, the unit including: a controller for outputting a control signal; a switching unit for outputting a DC square wave voltage in response to the control signal; an inverter for converting the DC square wave voltage into an AC voltage; and a lamp for emitting light in response to the AC voltage, the lamp including first and second glass tube portions having respective one ends bent and connected integrally to each other, first and second electrodes respectively formed at respective other ends of the first and second glass tube portions, and a third electrode formed at the bent portion of the first and second glass tube portions, wherein electrical characteristics of the lamp are detected through the third electrode.

In a still yet another aspect of the present invention, there is provided a liquid crystal display device having a liquid crystal panel for displaying an image, and a unit for driving a backlight assembly to supply light to the liquid crystal panel, the unit including: a controller for outputting a control signal; a switching unit for outputting a DC square wave voltage in response to the control signal; an inverter for converting the DC square wave voltage into an AC voltage; and a lamp for emitting light in response to the AC voltage, the lamp including first and second glass tube portions having respective one ends bent and connected integrally to each other, first and second electrodes respectively formed at respective other ends of the first and second glass tube portions, and a third electrode formed at the bent portion of the first and second glass tube portions, wherein an AC voltage having a phase opposite to a phase of an AC voltage supplied to the first and second electrodes is supplied to the third electrode.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1A:
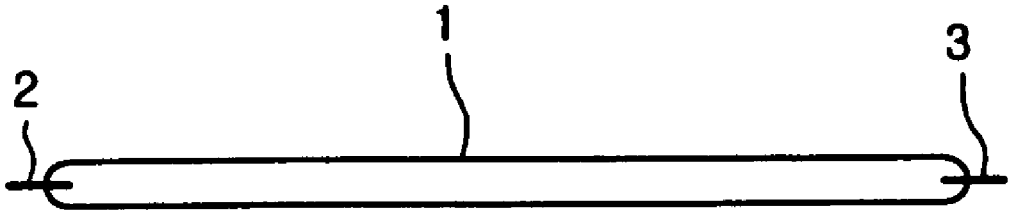
Fig. 1A Related Art
FIGS. 1A and 1B are views illustrating related art CCFLs for a backlight assembly.
Figure 1B:
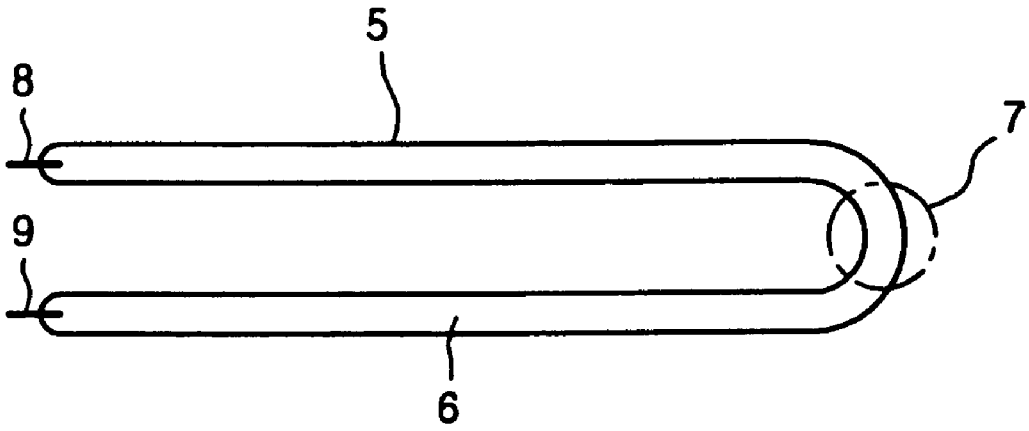
Fig. 1B Related Art
Figure 2:
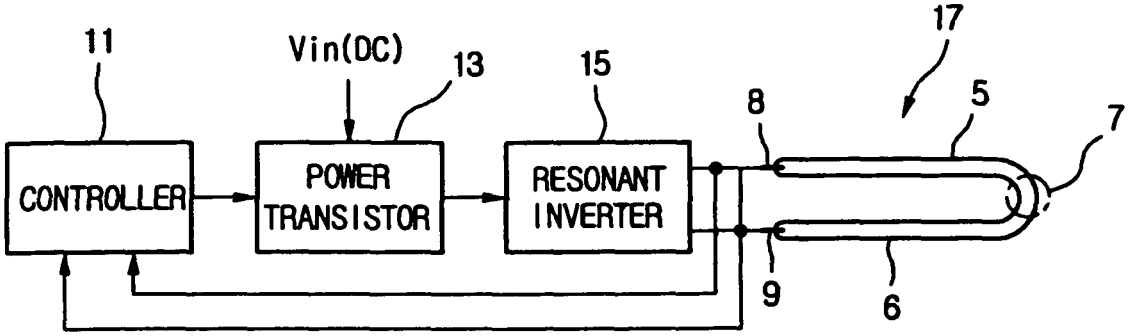
Fig.2 Related Art
FIG. 2 is a schematic diagram illustrating a driving device for a backlight assembly having the U-shaped lamp shown in FIG. 1B.
Figure 3:
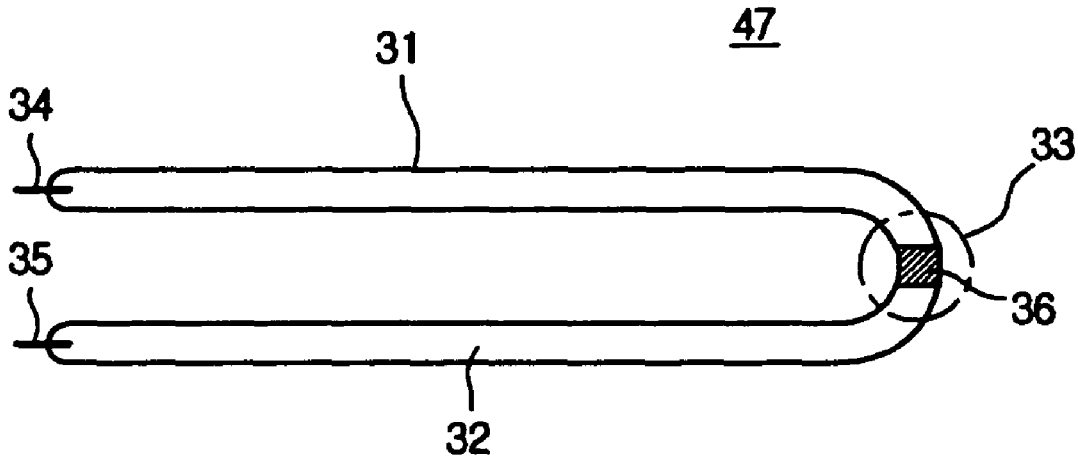
FIG. 3 is a view illustrating a CCFL for a backlight assembly according to an embodiment of the present invention.

FIG. 3 is a view illustrating a CCFL for a backlight assembly according to an embodiment of the present invention. Referring to FIG. 3, the CCFL includes first and second glass tube portions 31 and 32 of a predetermined length whose respective one ends are bent and connected integrally to each other at a connected portion 33, first and second electrodes 34 and 35 respectively formed at respective other ends of the first and second glass tube portions to be exposed to respective insides of the respective other ends, and a third electrode 36 formed at the connected portion 33 of the first and second glass tube portions. That is, the CCFL is a modified U-shaped lamp 47 (see FIGS. 4 to 6) that additionally includes a third electrode 36 at the connected portion 33 as compared to the related art U-shaped lamp.

The first and second glass tube portions 31 and 32 are formed of transparent glass having a predetermined length. The predetermined length may be proportional to the size of a liquid crystal panel. That is, when the liquid crystal panel is small, the tube portions 31 and 32 are formed to be short. Otherwise, when the liquid crystal panel is large, the tube portions 31 and 32 are formed to be long. Since the tube portions 31 and 32 have the same length, the first and second electrodes 34 and 35 are located at the same horizontal position. The tube portions 31 and 32 are filled with a discharge material (such as mercury) for discharging electricity, and a fluorescent material is coated on inner surfaces of the tube portions 31 and 32. For smooth power supply, the fluorescent material is not coated on a portion at which the first and second electrodes and the first and second glass tube portions are connected to each other.

The first to third electrodes 34 to 36 may be formed of a conductive material, such as Al, Ag, Cu, and the like. The first and second electrodes 34 and 35 are needle-shaped and are inserted respectively into the first and second glass tube portions 31 and 32 to a predetermined depth. On the contrary, the third electrode 36 is formed by attaching a metal tape around an outer periphery of the connected portion of the first and second glass tube portions 31 and 32, or by coating the outer periphery of the connected portion with a conductive material.

Depending on the purpose of the CCFL, the third electrode 36 may be grounded, may be connected to a controller so as to detect electrical characteristics of the CCFL, or may be electrically connected to a power supply unit so that a third voltage is directly supplied from the power supply unit to the third electrode. A first voltage and a second voltage may be supplied from the power supply unit to the first and second electrodes 34 and 35, respectively.

Figure 4:
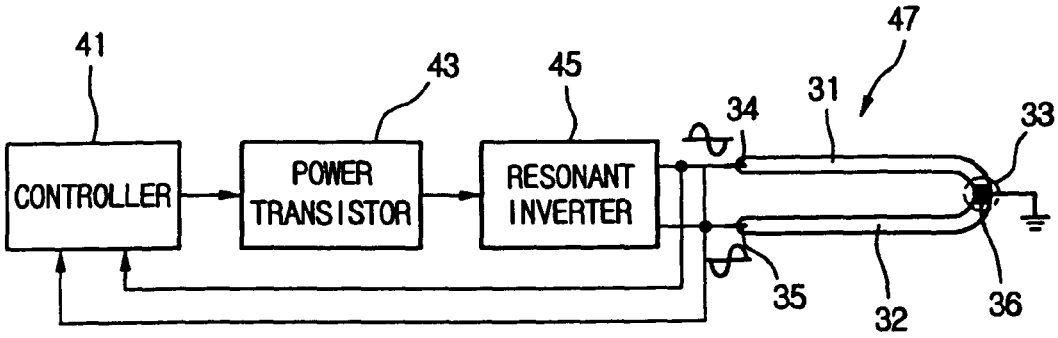
FIG. 4. is a schematic diagram illustrating a driving device for a backlight assembly according to a first embodiment of the present invention.

FIG. 4. is a schematic diagram illustrating a driving device for a backlight assembly according to a first embodiment of the present invention. Referring to FIG. 4, the backlight assembly driving device includes a controller 41 for outputting a PWM (pulse width modulation) control signal, a power transistor 43 for converting an external DC voltage into a DC square wave voltage in response to the control signal, a resonant inverter 45 for converting the DC square wave voltage into an AC sine wave voltage, and a U-shaped lamp 47 for emitting light. The U-shaped lamp 47 is also provided with the third electrode 36 that is grounded.

The controller 41 outputs a PWM control signal for controlling the power supplied to the U-shaped lamp 47. The PWM control signal is applied to a gate of the power transistor 43, and an external DC voltage is supplied to a drain of the power transistor 43. The power transistor 43 is periodically turned on/off according to the PWM control signal and accordingly the DC voltage is converted into a DC square wave voltage having a plurality of pulses.

The resonant inverter 45 includes a resonator and a transformer. The resonator includes a resistor, an inductor, and a capacitor. The resonator converts a DC square wave voltage into an AC sine wave voltage, and the transformer boosts the AC sine wave voltage from the resonator. Although only one resonant inverter is illustrated in FIG. 4 for simply describing the device, two resonant inverters are required for providing an AC voltage to each of the electrodes 34 and 35 in the U-shaped lamp 47.

A first AC voltage and a second AC voltage are applied respectively to the electrodes 34 and 35. In the related art, the phase of the first AC voltage is opposite to that of the second AC voltage. Since there is a grounded third electrode 36 at the bend portion 33, the phase of the first AC voltage may be opposite to or identical to that of the second AC voltage in embodiments of the present invention.

In the U-shaped lamp 47, the first and second electrodes 34 and 35 are formed respectively at respective ends of the first and second glass tube portions 31 and 32, and the third electrode 36, connected to ground, is formed at the connected portion 33 of the tube portions 31 and 32. The first and second electrodes 34 and 35 are connected to the resonant inverter 45. Accordingly, first and second AC voltages having opposite phases are applied respectively to the first and second electrodes 34 and 35. Since the third electrode 36 is grounded, a phase of the first voltage may be opposite to or identical to that of the second voltage. That is, it does matter whether a phase of the first voltage is opposite to or identical to that of the second voltage.

In contrast, the bent portion of the floating type U-shaped lamp according to the related art is not grounded. Accordingly, there is a possibility that the first and second voltages having opposite phases may cancel each other at other portions of the lamp rather than at the bent portion due to impedance differences between the respective glass tube portions. Accordingly, the brightness at the abovementioned other portions may be undesirably degraded. Also, since electrical characteristics are detected between the resonant inverter and the U-shaped lamp, the electrical characteristics of the related art U-shaped lamp cannot be detected.

Since the third electrode 36 of the U-shaped lamp 47 is grounded, a ground voltage always exists at the connected portion 33. Accordingly, the brightness of the glass tube portions 31 and 32 becomes nearly uniform, and stable electrical characteristics can be obtained. Also, the third electrode 36 can used as a reference point. Accordingly, the internal impedance of the glass tube portions 31 and 32 can be maintained. Consequently, a tube current flowing through the glass tube portions 31 and 32 can be prevented from becoming different.

Figure 5:
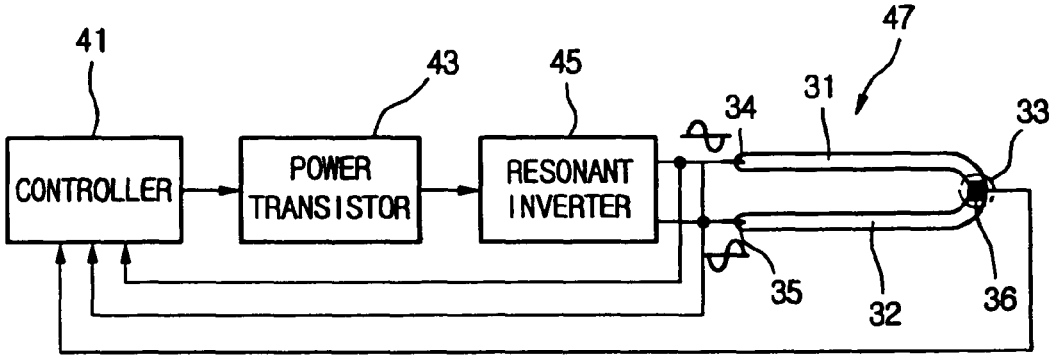
FIG. 5. is a schematic diagram illustrating a driving device for a backlight assembly according to a second embodiment of the present invention.

FIG. 5. is a schematic diagram illustrating a driving device for a backlight assembly according to a second embodiment of the present invention. In the driving device according to the second embodiment, the third electrode 36 of the lamp 47 is electrically connected to the controller 41 as shown in FIG. 5. The other structures and connections are identical to those of the driving device shown in FIG. 4, and thus their detailed description will be omitted for simplicity.

Referring to FIG. 5, the third electrode 36 of the lamp 47 is electrically connected to the controller 41, and the electrical characteristics of the U-shaped lamp 47 (for example, a voltage, a current, and an impedance of the glass tube portions 31 and 32) are detected at the connected portion 33 through the third electrode 36. Also, electrical characteristics between the resonator 45 and the lamp 47 are detected. However, these electrical characteristics reflect the electrical characteristics of the resonant inverter 45, not the lamp 47. Accordingly, an impedance matching and a brightness adjustment for the lamp 47 are accurately controlled by detecting the accurate electrical characteristics of the lamp 47.

Figure 6:
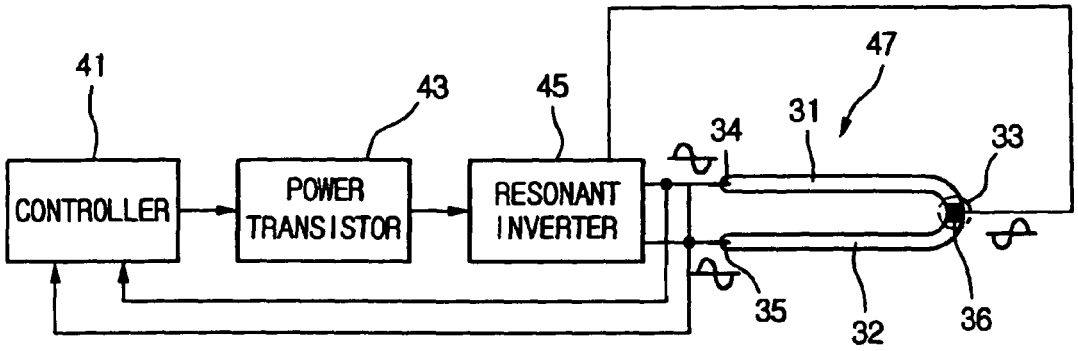
FIG. 6. is a schematic diagram illustrating a driving device for a backlight assembly according to a third embodiment of the present invention.

FIG. 6. is a schematic diagram illustrating a driving device for a backlight assembly according to a third embodiment of the present invention. Referring to FIG. 6, first and second AC voltages are supplied respectively to the first and second electrodes 34 and 35. Also, a third AC voltage is supplied to the third electrode 36. For this purpose, the third electrode 36 is also connected to the resonant inverter 45. At this time, first and second AC voltages having the same phase are supplied respectively to the first and second electrodes 34 and 35, and a third AC voltage having a phase opposite to a phase of the first and second AC voltages is supplied to the third electrode 36.

In general, lamps become longer for a wide screen liquid crystal panel. When an AC voltage is supplied to one end of a long lamp, the supplied AC voltage drops across the length of the long lamp. Accordingly, a greatly-reduced AC voltage is supplied to the other end of the long Lamp. Consequently, the brightness at the other end of the long lamp is greatly reduced. The third embodiment solves this problem. That is, brightness at the connected portion 33 is increased by supplying the third AC voltage having a phase opposite to a phase of the first and second AC voltages to the third electrode 36 provided at the connected portion 33.

Although the CCFL has been described above for use in embodiments of the present invention, an external electrode fluorescent lamp (EEFL) can also be used in embodiments of the present invention. In the case of the EEFL, an electrode is not exposed to an inside of an end portion of a glass tube. In the EEFL, an electrode may be formed at an end portion of a glass tube, or may be formed at any portion between both end portions of the glass tube. When an EEFL lamp having electrodes formed at both outer end portions thereof is bent in a U-shaped and a third electrode is formed at the bent portion thereof, the present invention can also be applied to the EEFL. Also, although the U-shaped Lamp has been described above, the present invention can also be applied to a zigzag lamp.

As described above, in embodiments of the present invention, an impedance difference between the respective glass tube portions is removed by grounding the electrode provided at the bent portion of the lamp. Accordingly, a stable output can be obtained. Also, the accurate electrical characteristics of the lamp can be simply detected using the third electrode provided at the bent portion of the lamp. Accordingly, a reliability can be improved. Further, a third AC voltage can be supplied to the third electrode provided at the bent portion of the lamp. Accordingly, an uniform brightness can be obtained even in a wide screen display device.

It will be apparent to those skilled in the art that various modifications and variations can be made in the lamp and a driving device for a backlight assembly having the same of the present invention. Thus, it is intended that the present invention covers the modifications and variations of this invention provided they come within the scope of the appended claims and their equivalents.

What is claimed is:

1. A device for driving a backlight assembly, comprising:

a controller for outputting a control signal;

a switching unit for outputting a DC square wave voltage in response to the control signal;

an inverter for converting the DC square wave voltage into an AC voltage; and a lamp for emitting light in response to the AC voltage, the lamp including:

first and second glass tube portions having respective one ends bent and connected integrally to each other;

first and second needle-shaped electrodes respectively formed at respective other ends of the first and second glass tube portions and connected to the inverter, wherein a first end of the electrodes extends inside the glass tube portions and wherein first and second AC voltages having opposite phases are applied respectively to the first and second needle shaped electrodes; and a third electrode formed on an outer periphery and at the bent portion of the first and second glass tube portions and electrically connected to the controller, wherein electrical characteristics of the lamp only are detected through the third electrode, wherein the electrical characteristics include voltage, current and impedance of the lamp.

2. The device according to claim 1, wherein the controller controls the lamp in response to the detected electrical characteristics.

3. The device according to claim 1, wherein the lamp is a U-shaped lamp or a zigzag shaped lamp.

4. The device according to claim 1, wherein the lamp is a CCFL (cold cathode fluorescent lamp).

5. A liquid crystal display device comprising:

a liquid crystal panel for an image; and a unit driving a backlight assembly to supply light to the liquid crystal panel, the unit including:

a controller for outputting a control signal;

a switching unit for outputting a DC square wave voltage in response to the control signal;

an inverter for converting the DC square wave voltage into an AC voltage; and a lamp for emitting light in response to the AC voltage, the lamp including:

first and second glass tube portions having respective one ends bent and connected integrally to each other;

first and second needle-shaped electrodes respectively formed at respective other ends of the first and second glass tube portions and connected to the inverter, wherein a first end of the electrodes extends inside the glass tube portions and wherein first and second AC voltages having opposite phases are applied respectively to the first and second needle shaped electrodes; and a third electrode formed on an outer periphery and at the bent portion of the first and second glass tube portions and electrically connected to the controller, wherein electrical characteristics of the lamp only are detected through the third electrode, wherein the electrical characteristics include voltage, current and impedance of the lamp.

* * * * *